United States Patent [19]

Peetz et al.

[11] Patent Number: 4,729,441

[45] Date of Patent: Mar. 8, 1988

[54] ROCK DRILL

[75] Inventors: Wolfgang Peetz, Blitzenreute; Bernhard Moser, Altshausen, both of Fed. Rep. of Germany

[73] Assignee: Hawera Probst GmbH & Co., Ravensburg, Fed. Rep. of Germany

[21] Appl. No.: 753,629

[22] Filed: Jul. 10, 1985

[30] Foreign Application Priority Data

Jul. 21, 1984 [DE] Fed. Rep. of Germany ..... 3426977

[51] Int. Cl.[4] ..... E21B 10/46; E21B 10/26

[52] U.S. Cl. ..... 175/385; 175/410; 175/411; 175/414

[58] Field of Search ..... 175/409–414, 175/419, 420, 374, 385, 389, 390; 228/122, 263.12; 76/108 A

[56] References Cited

U.S. PATENT DOCUMENTS

| | | | |
|---|---|---|---|
| 2,030,576 | 2/1936 | Erickson . | |
| 2,101,376 | 12/1937 | Voigtlander | 175/411 |
| 2,341,314 | 2/1944 | Clark | 407/118 |
| 2,522,045 | 9/1950 | Knowles | 175/410 |
| 2,707,619 | 5/1955 | Andersson | 175/414 |
| 2,777,672 | 1/1957 | Haglund et al. | 175/410 |
| 3,459,073 | 8/1969 | Conover | 76/108 |
| 3,549,337 | 12/1970 | Palmer | 228/122 |
| 3,960,223 | 6/1976 | Kleine | 175/410 |
| 4,190,127 | 2/1980 | Wolf | 175/410 |
| 4,294,319 | 10/1981 | Guergen | 175/410 |

FOREIGN PATENT DOCUMENTS

| | | | |
|---|---|---|---|
| 630138 | 5/1936 | Fed. Rep. of Germany . | |
| 175859 | 8/1953 | Fed. Rep. of Germany | 407/118 |
| 1101095 | 3/1961 | Fed. Rep. of Germany | 407/118 |
| 2414354 | 10/1975 | Fed. Rep. of Germany . | |
| 2952295 | 7/1981 | Fed. Rep. of Germany | 175/390 |
| 1414023 | 9/1965 | France . | |
| 172635 | 9/1960 | Sweden | 175/414 |
| 692373 | 6/1953 | United Kingdom . | |

*Primary Examiner*—James A. Leppink
*Assistant Examiner*—Hoang C. Dang
*Attorney, Agent, or Firm*—Spencer & Frank

[57] ABSTRACT

A rock drill in which the depth of the recessed groove for accommodating the cutting body is made greater than the axial brazing-in depth of the cutting body whereby a largely stress-free seating of the cutting body results. In particular, for rock drills for making breakthroughs, this recessed groove extended in the radial direction into lobes of a drill head can be used for locating cutting bodies in the lobes.

12 Claims, 8 Drawing Figures

ROCK DRILL

BACKGROUND OF THE INVENTION

1. Field of the Invention

The invention relates to a rock drill having radial recessed grooves for locating cutting bodies therein which are to be brazed in, and in particular to a rock drill for break-throughs having a drill head body which is arranged at the end of a drill shank and has at least two radially projecting lobes provided with cutting bodies and also has a central extension which has cutting bodies and is axially arranged in the drilling direction in front of the lobes.

2. Background of the Art

In known rock drills, carbide cutting bodies are brazed by the brazing method into cutting body locating grooves of a steel drill head. At the same time, the depth of the cutting body locating groove is of such a size that the cutting body sits on the groove route during the brazing process in order to achieve a precisely defined position. With this method, it is accepted that, during the brazing process and as a result of the considerably different coefficients of expansion of carbide and steel (factor about 1:2), stresses will develop particularly in the lower area of the recessed groove which can lead to weakening of the connection during extreme loading.

This problem is equally known with normal rock drills as well as with rock drills for producing break-throughs, such as can be inferred, for example, from German Pat. No. 2,414,354. The center extension on such tools is principally constructed in the same way as normal carbide drills; that is, the center extension has an appropriate carbide cutting body. In addition, it is also necessary with the known rock drills for making break-throughs to incorporate grooves or holes in the lobes pointing radially outwards, which grooves or holes are used to locate the carbide cutting bodies in the lobes. These individually tip-locating grooves in the lobes must be made by means of end milling cutters or similar, which makes the manufacturing process more expensive.

SUMMARY OF THE INVENTION

The object of the invention is to remove the above-mentioned disadvantages, that is, to create a seat, which is as stress-free as possible, for carbide cutting bodies in rock drills, and in this connection to simplify and thus arranged more cost-effectively the manufacturing process in particular of rock drills for producing break-throughs.

This object is achieved by providing a first embodiment of a rock drill having radial, recessed grooves for locating cutting bodies to be brazed in, wherein the depth of the recessed groove for the cutting body is made larger than the axial brazing-in depth of the cutting body, and, in particular, by the further provision of a second embodiment of a rock drill for making break-throughs having a drill head body which is arranged at the end of a drill shank and has at least two radially projecting lobes provided with cutting bodies and also has a center extension which has cutting bodies and is axially arranged in the drilling direction in front of the lobes, wherein the depth of the recessed groove extends through the axial center extension into the area of the radial lobes.

The installation according to the invention of a carbide cutting body without lower support has a favorable effect on the stress condition in the drill head. The reason for this can be seen as follows.

With the steel-carbide material pairing, the thermal expansion ratio is about 2:1. At room temperature and before the brazing process, the lengths of carbide and steel are initially all the same. During the heating up to brazing temperature, the steel then expands substantially more than the carbide. When the connection cools down to the solidification temperature of the brazing filler metal, the longitudinal expansion of the steel is always considerably greater than that of the carbide. Further cooling down to room temperature then causes the assembled connection to warp—in a similar way to a bi-metal. However, this bending cannot bake place with a drilling tool because in practise the carbide tip is enclosed on both sides by steel as a result of the slot brazing. Accordingly, tensile stresses must exist in the steel body, which stresses are greatest in the slot route. Tensile stresses also exist in the carbide tip in the transverse direction.

According to the invention, the carbide cutting body can now at least partially follow the shrinkages in the steel, so that the stresses are considerably reduced in both the steel and the carbide cutting body, and in particular do not exist directly in the slot route. This area is in any case greatly endanged as a fracture location as a result of stress concentration.

If a slot which penetrates deeper is made according to the invention for the above stated reasons, the previously discussed second inventive embodiment follows as a further development of this idea.

In contrast to known, one-piece rock drills for making break-throughs, the invention accordingly has the further advantage that, in the case of a rock drill with two lobes, all grooves for locating cutting bodies can be made in just one operation. For this purpose, the groove is axially made so deep, according to the invention, through the center extension by a side milling cutter that it engages at the same time into the lobes of the drill head body. A continuous, radial groove is accordingly developed which cuts through both the center extension along its full axial length and the lobes down to the specified depth for the cutting bodies.

The continuous groove according to the invention for forming the cutting tip seat in the lobes also facilitates, in an advantageous manner, optimum brazing of the cutting bodies into the lobes. This is achieved in that, as a result of the available space on both sides of the respective cutting element, it is possible to correctly measure out and feed the brazing filler metal.

The principle according to the invention, in the case of a one piece rock drill, can be applied both the two lobes and to lobes exceeding this number, provided the lobes are arranged diametrically to one another. According to the invention, the possibility of simplified manufacturing of one piece rock drills and thus the more economical manufacture of such break-through tools are decisive factors.

Advantageous further developments and improvements of the invention are possible by means of the measures stated in the further sub claims. In the case of a rock drill, an expendient length ratio for accomplishing the overall depth of the groove is preferably such that the difference between the slot depth (t) and the axial brazing-in depth of the cutting body is at least 0.5 times the slot width.

The previously discussed second embodiment of the basic idea according to the invention a rock drill in particular for producing break-throughs has production advantages because of a simple design.

Further, several cutting bodies can be arranged radially next to one another in one groove in order to increase consequently the cutting capacity if necessary. For this purpose, it is not necessary for new grooves, or slots, or holes, to be made in the lobes by expensive production processes. Thus, according to further variations of the second embodiment of the invention, the cutting body seat for the cutting bodies of the symmetrically arranged lobes and for the cutting body of the center extension may be formed by a continuous, radial recessed groove which can be made in one operation and/or each lobe has at least two cutting bodies arranged radially next to one another.

It is expedient in the case of the special rock drill for producing break-throughs to arrange the groove through the lobes in a displaced manner above a certain angle to the symmetrical plane. According to another variation of the second embodiment of the invention, the cutting body locating groove may be arranged in a displaced manner relative to the center longitudinal axis through the lobes about an angle $\alpha \approx 18°$. In this way, for one rotary movement of the tool in the clockwise direction, early engagement of the cutting bodies in the material to be drilled and increased support of the cutting bodies by the drill head body are ensured.

Several radial grooves can be arranged relative to one another at a certain angle in one finger. Thus, the two oppositely located lobes and the intermediately located center extension may have several continuous recessed grooves displaced at an angle $\beta$. In this way, the cutting capacity can also be increased for special applications.

Four symmetrically arranged lobes may be provided which have recessed grooves running through across the center extension for locating cutting bodies. Thus, as is known per se, four symmetrically arranged lobes may be made, however, by means of the measures according to the invention.

The cutting body of the center extension may be designed as a cross bit. Thus, an advantageous embodiment of the invention also extends to cross bits.

BRIEF DESCRIPTION OF THE DRAWING

Illustrative embodiments are described in greater detail in the following description and shown in the drawing, wherein.

DESCRIPTION OF THE PREFERRED EMBODIMENTS

Figure 1:
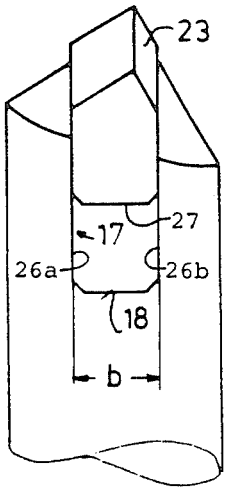
FIG. 1 shows an elevation side view of a first embodiment of a rock drill according to the invention with extended cutting body recessed groove.
Figure 2:
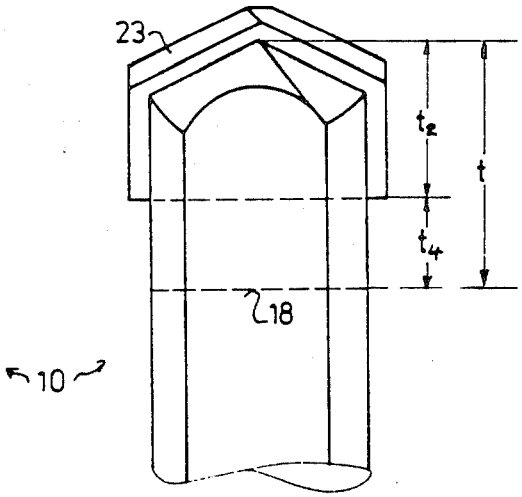
FIG. 2 shows the representation according to FIG. 1 turned through 90°.
Figure 3:
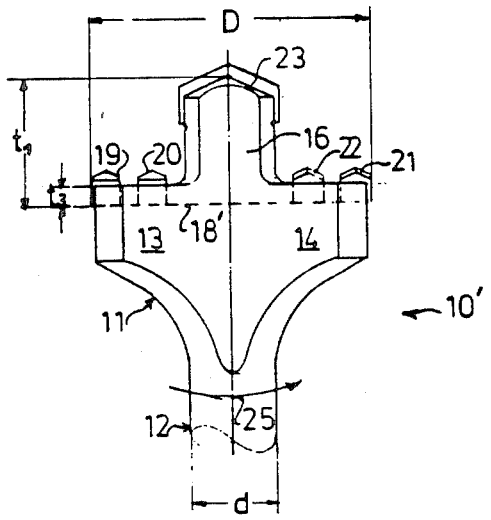
FIG. 3 shows an elevational side view of a second embodiment of a rock drill according to the invention for producing break-throughs.
Figure 4:
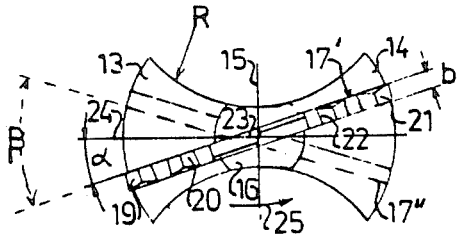
FIG. 4 shows a top plan view of the rock drill according to FIG. 3.

The rock drill 10 shown in FIGS. 1 and 2 itself can be a standard twist drill, as well as being the center point or center extension 16 of a rock drill 10' according to the representation in FIGS. 3 and 4. If significance is the largely stress-free seating of carbide cutting body-cutting element 23 in cutting body locating groove 17. According to the representation in FIGS. 1 and 2, it can be seen that depth t of the cutting body locating groove 17 or recessed groove 17, which has a pair of side walls *26a*, *26b* and is to be made by means of a side milling cutter, is greater than penetration depth $t_2$ of the carbide cutting body 23. Clearance step $t_4$ between the cutting body 23 and groove root, i.e., groove bottom surface 18 at least 0.5 times a slot width or cutting body width b. In this way, lower edge 27 of the cutting body 23 does not sit against the root 18 of the recessed groove 17. The width b of the slot or the groove 17 is constant.

The precondition for this arrangement is that the brazed surface, in conjunction with the shearing resistance of the brazing filler metal, can accommodate the loading on the cutting tip. With a drill having a nominal diameter of 25 millimeters, the following calculation can be made: brazed surface about 430 $mm^2$, shearing resistance of brazing filler metal about 150 to 300 $N/mm^2$. From this results the following loading capacity:

Minimum: $430 \times 150 = 64{,}500N$ ($\approx 6.45$ tonnes)

Maximum: $430 \times 300 = 129{,}000N$ ($\approx 12.9$ tonnes).

Depending on the hammer drill, the loads occurring in practise are in the range of about 2 to 4 tonnes.

From this it can be seen that the method according to the invention leads to a reduction in the stresses at an adequate loading capacity of the drill head.

The further embodiment shown in FIGS. 3 and 4 is a logical extension of the idea according to the invention to a drill for producing break-throughs and has the same advantages. The same parts are therefore stated with corresponding reference numbers.

The rock drill 10', shown in side view in FIG. 3, consists of a drill head body 11 which is integrally formed onto a cylindrical shank 12 of a break-through tool.

According to the representation in FIGS. 3 and 4, the drill head body 11 consists of two radial sections which are designated as lobes 13 and 14 and are made in a way known per se. The lobes 13 and 14 are made symmetrically with respect to axis plane 15.

A center extension 16, which is used for making a center hole, is located in the drilling direction in front of the lobes 13 and 14.

According to the invention, a continuous cutting body locating groove 17' is produced, for example, by means of a side milling cutter, which locating groove 17' extends in an aligned manner from the outermost radial point of the lobe 13 over the center extension 16 to the outermost radial point of the lobe 14. A lower edge or groove root 18' of the locating groove 17' which can be seen in top plan view in FIG. 4, is indicated as a dotted line in FIG. 3. The locating groove 17' slits the center extension 16 along its entire length, so that the side milling cutter for making the locating groove 17' must penetrate into the drill head body 11 to a depth $t_1$.

Cutting bodies 19 and 20 are positioned in the lobe 13, and cutting bodies 21 and 22 are positioned in the lobe 14, and cutting body 23 of the center extension 16, which cutting body 23 is displaced in the axial direction, are brazed by the known brazing method into this continuous cutting body locating groove 17' which is made in one operation. In this connection, it is important for manufacturing reasons that the cutting bodies 19 to 22 are easily accessible from the side so that the brazing filler metal can be optimally measured out and the brazing process optimally arranged. Also, according to the invention, the cutting body 23 of the center extension 16, because of the continuous groove 17', is not limited in the downward direction, so that less stress concentration occurs during brazing than during firm gripping.

According to the representation in FIG. 4, it is particularly advantageous that the cutting body locating groove 17' is made in a displaced manner about an angle $\alpha \approx 180°$ relative to symmetrical plane 24 through the lobes 13 and 14. In this way, during one rotary movement of the tool in the clockwise direction (arrow 25), early engagement of the cutting bodies 19 to 22 into the material to nbe drilled and increased support of the cutting bodies by the drill head body 11 are ensured.

Figure 5:
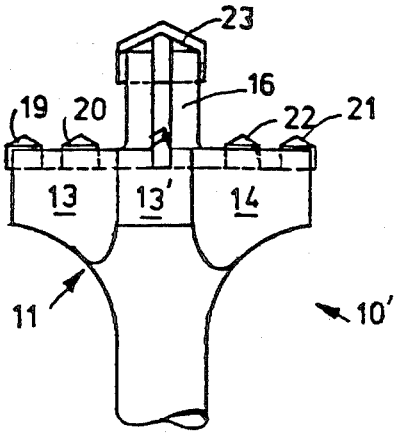
FIG. 5 shows an elevational side view of a variation of a second embodiment of the rock drill having four radial sections which are symmetrically arranged lobes.
Figure 6:
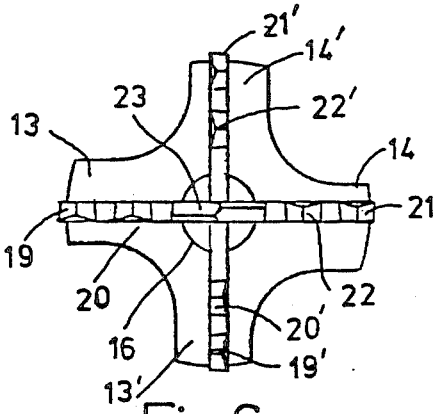
FIG. 6 shows a top plan view of the rock drill according to FIG. 5.
Figure 7:
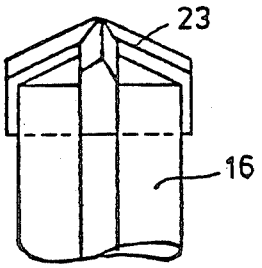
FIG. 7 shows an elevational side view of a variation of the rock drill wherein the cutting body of the center extension is a cross, bit
Figure 8:
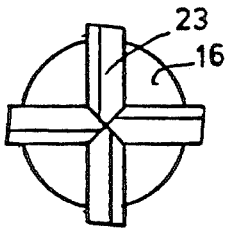
FIG. 8 shows a top plan view of the rock drill according to FIG. 7.

By means of this measure, it is also possible to provide a further cutting body locating groove 17'', shown is phantom in FIG. 4, displaced at an angle, in the lobes 13 and 14 in order to achieve an increased cutting capacity with only two lobes. Of course, more than two lobes can also be used, that is, for example, an arrangement according to the literature mentioned at the beginning and as shown in FIGS. 5 and 6, for which arrangement, the cutting body 23 of the center extension 16 is a cross bit as shown in FIGS. 7 and 8.

The rock drill shown in the illustrative embodiment according to FIGS. 3 and 4 has, for example, an outside diameter of $D=68$ mm and a shank diameter of $d=19$ mm. The radius R shown in FIG. 2 is about 32 mm. The penetration depth $t_2$ in the lobes 13 and 14 is about 4.5 mm and the groove width b is also about 4.5 mm.

What is claimed is:

1. A rock drill comprising:

a drill head body having a longitudinal axis and having at least one radially projecting recessed groove provided therein, which recessed groove has a pair of sidewalls and a bottom surface, which bottom surface extends from one sidewall to the other sidewall, and which recessed groove extends the entire width of the drill head body, and has a groove depth measured along said longitudinal axis; and at least one cutting body seated in and brazed together with said at least one radially projecting recessed groove, which cutting body has a lower edge, which lower edge faces the bottom surface of the recessed groove, and a groove penetration depth measured along said longitudinal axis, wherein said groove depth is greater than said groove penetration depth, whereby a clearance space is defined between the bottom surface of the recessed groove and the lower edge of the cutting body prior to and after brazing, such that a stress-reduced seating of said at least one cutting body is provided after brazing.

2. The rock drill according to claim 1, wherein each said at least one radially projecting recessed groove has a groove width, and wherein the difference between the groove depth and the groove penetration depth is at least 0.5 times the groove width.

3. The rock drill according to claim 1, wherein each said at least one cutting body comprises a cross kit.

4. A rock drill for making break-throughs, comprising:

a drill shank having a longitudinal axis;

a drill head body positioned at one end of said drill shank and having at least one pair of radially projecting, diametrically opposing lobes and having a center extension positioned centrally and extending outwardly therefrom along said longitudinal axis, said drill head body having at least one radially projecting recessed groove provided therein, each said at least one radially projecting recessed groove having a pair of sidewalls and a bottom surface, which bottom surface extends from one sidewall to the other sidewall of said at least one radially projecting recessed groove, each said at least one radially projecting recessed groove extending radially through one of said at least one pair of radially projecting, diametrically opposing lobes and said center extension, and having a groove depth measured along said longitudinal axis;

at least one cutting body seated in said center extension and brazed to that portion of the at least one radially projecting recessed groove which extends through said center extension, each said at least one cutting body having a lower edge, which lower edge faces the bottom surface of the recessed groove, and a groove penetration depth measured along said longitudinal axis; and a plurality of cutting bodies seated in and brazed to that portion of said at least one radially projecting recessed grooves which extends through at least one of said at least one pair of radially projecting, diametrically opposing lobes, wherein said groove depth is greater than said groove penetration depth of said at least one cutting body seated in said center extension, whereby a clearance space is defined between the bottom surface of that portion of the at least one radially projecting recessed groove which extends through said center extension and the lower edge of said at least one cutting body prior to and after brazing, such that a stress-reduced seating of said at least one cutting body is provided after brazing.

5. The rock drill according to claim 4, wherein each said at least one pair of radially projecting, diametrically opposing lobes has a first lobe and a second lobe, and wherein each said at least one radially projecting recessed groove is a continuous recessed groove and extends radially and continuously through the first lobe of one said at least one pair of lobes, through said center extension, and through the second lobe of said one said at least one pair of lobes.

6. The rock drill according to claim 4, wherein at least two cutting bodies are arranged radially next to one another for each lobe.

7. The rock drill according to claim 4, wherein one pair of radially projecting diametrically opposing lobes is provided and has a symmetrical plane extending longitudinally through the center thereof and wherein a plurality of radially projecting recessed grooves are provided and are each displaced relative to said symmetrical plane by a predetermined angle.

8. The rock drill according to claim 7, wherein two radially projecting recessed grooves are provided and are each displaced relative to said symmetrical plane by an angle $\alpha$=about 18°.

9. The rock drill according to claim 4, wherein two pair of radially projecting, diametrically opposing lobes are provided and are symmetrically arranged with respect to one another.

10. The rock drill according to claim 9, wherein said center extension is provided with one cutting body, which cutting body comprises a cross bit.

11. The rock drill according to claim 4, wherein said center extension is provided with one cutting body, which cutting body comprises a cross bit.

12. The rock drill according to claim 4, wherein each said at least one radially projecting recessed groove has a groove width, and wherein the difference between the groove depth and the groove penetration depth is at least 0.5 times the groove width.

* * * * *